United States Patent [19]

Igarashi et al.

[11] Patent Number: 4,552,568

[45] Date of Patent: Nov. 12, 1985

[54] METHOD FOR PREPARING COAL-WATER SLURRY

[75] Inventors: Taizo Igarashi; Hisao Higuchi; Shingo Yamazaki, all of Hyogo, Japan

[73] Assignee: Nippon Oil and Fats Co., Ltd., Tokyo, Japan

[21] Appl. No.: 516,089

[22] Filed: Jul. 22, 1983

[30] Foreign Application Priority Data

Jul. 24, 1982 [JP] Japan ..... 57-129496

[51] Int. Cl.[4] ..... C10L 1/32

[52] U.S. Cl. ..... 44/51; 406/47; 406/49; 406/197

[58] Field of Search ..... 44/51; 406/47, 49, 197

[56] References Cited

U.S. PATENT DOCUMENTS

| | | | |
|---|---|---|---|
| 4,104,035 | 8/1978 | Cole et al. | 44/51 |
| 4,242,098 | 12/1980 | Braun et al. | 44/51 |
| 4,274,836 | 6/1981 | Ban et al. | 44/6 |
| 4,282,006 | 8/1981 | Funk | 44/51 |
| 4,288,231 | 9/1981 | Taylor | 44/1 R |
| 4,304,573 | 12/1981 | Burgess et al. | 44/51 |
| 4,332,593 | 6/1982 | Burgess et al. | 44/51 |
| 4,394,132 | 7/1983 | Taylor | 44/51 |
| 4,441,887 | 4/1984 | Funk | 44/51 |

*Primary Examiner*—William R. Dixon, Jr.
*Assistant Examiner*—Margaret B. Medley
*Attorney, Agent, or Firm*—Sughrue, Mion, Zinn Macpeak & Seas

[57] ABSTRACT

A method for preparing a coal-water slurry is described, comprising the divided addition of dispersing agent or multi-step addition of dispersing agent during grinding in a process for preparing a coal-water slurry by the wet grinding of coal in water.

10 Claims, No Drawings

METHOD FOR PREPARING COAL-WATER SLURRY

FIELD OF THE INVENTION

The present invention relates to a method for preparing a coal-water slurry by the wet grinding of coal in water.

BACKGROUND OF THE INVENTION

Oil has occupied the premier position as fuel for a long time in contract to the use of coal having the form of a solid. However, since the oil crisis, new merits have been discovered in coal and there have been numerous attempts to handle coal as a fluid by mixing it with a fluid medium, e.g., by a coal oil mixture. However, because a coal oil mixture cannot avoid the defect that it contains oil forming about one-half of its content; development of other slurry fuels has been demanded.

In recent years, attempts to prepare a coal-water fluid slurry suitable for pipeline transportion and for oil tanker transportation by dispersing coal in a water medium in a high concentration, and further to use the slurry in boilers as an alternative fuel for oil, have been carried out. Such slurry involves problems such as an increase in cost due to transportation of water in surplus when transported on ship and a lowering in heating value when burned as a fuel.

To minimize these problems, it is necessary to raise the concentration of coal in the slurry as much as possible, and to do so it becomes essential to add a dispersing agent, such as a surface active agent, to the slurry. However, countermeasures should be taken to make it possible to use as small an amount of surface active agent as possible, because these surface active agents are expensive.

As a method for preparing a coal-water slurry, a method of wet grinding of the coal is more often used than is the method by mixing dry coal powder with water, because of the former method's merits in preventing problems such as the formation of dust, the risk of ignition, and in the direct grinding of coal without drying after coal preparation.

For preparing a coal slurry of high concentration by the wet grinding of coal, a dispersing agent such as a surface active agent has heretofore been added into a grinding mill in advance of any grinding. However, large amounts of surface active agent are required, resulting in economically unattractive increase in the cost of coal-water slurry.

SUMMARY OF THE INVENTION

In accordance with the present invention, it has now been found that a coal-water slurry of low viscosity can be prepared by the divided addition or by the multi-step addition of a small total amount of dispersing agent into a wet grinding mill containing coal in water Thus the present invention comprises the divided addition of dispersing agent or multi-step addition of dispersing agent during grinding in a process for preparing a coal-water slurry by the wet grinding of coal in water. Thus, the preparation of a coal-water slurry of low viscosity by the wet grinding of coal with a very small total amount of dispersing agent added has been accomplished.

By reference to the addition of dispersing agent herein, it is to be understood that not only can a single dispersing agent be used, but also combinations thereof.

DETAILED DESCRIPTION OF THE INVENTION

A dispersing agent used in the present invention comprises solely a surface active agent or a system combining a surface active agent or a system combining a surface active agent with an alkaline substance, and it is important to carry out the divided addition of dispersing agent or multi-step addition of dispersing agent at least twice during the time required for completion of the wet grinding of coal. Further, with a system combining a surface active agent with an alkaline substance, there can be adopted several modes, such as: (1) a dividing mode comprising two respective divided portions, the first of a sole surface active agent and the second of an alkaline substance; (2) a dividing mode of further dividing one or both of the above-mentioned divided portions into smaller portions; or (3) a dividing mode of dividing the mixture of a surface active agent with an alkaline substance into at least two portions.

Surface active agents usable in the present invention include cationic surface active agents, anionic surface active agents, nonionic surface active agents, and amphoteric surface active agents. Anionic surface active agents and nonionic surface active agents are preferred.

Examples of useful anionic surface active agents include salts of lignin sulfonates, salts of naphthalene sulfonates, salts of alkylnaphthalene sulfonates, salts of alkylbenzene sulfonates, salts of formaldehyde condensates of said sulfonates, salts of polyoxyalkylene alkylphenyl ether sulfates, salts of polyoxyalkylene alkyl ether sulfates, salts of polyoxyalkylene polyol ether sulfates, salts of alkyl sulfates, fatty acid salts, salts of polyacrylic acid, salts of polymethacrylic acid and salts of copolymers of a polymerizable carboxylic acid (such as acrylic acid, methacrylic acid, maleic anhydride or the like) with a vinyl compound (such as $\alpha$-olefin, styrene or the like).

Examples of useful nonionic surface active agents include polyoxyalkylene alkyl ether, polyoxyalkylene alkylphenyl ether, polyoxyalkylene alkylamine, polyoxyalkylene fatty acid amide, polyoxyalkylene polyol ether, polyoxyalkylene fatty acid ester, polyoxyalkylene polyol fatty acid ester and polyol fatty acid ester.

Examples of useful cationic surface active agents include quaternary ammonium salts such as alkyl trimethyl ammonium halide, dialkyl dimethyl ammonium halide, trialkyl methyl ammonium halide, alkyl dimethyl benzyl ammonium halide, alkyl pyridinium halide, alkyl quinolinium halide, and amine salts such as acetic acid salts and hydrohalogenic acid salts of amines.

Examples of useful amphoteric surface active agents include alkyl betaine, and alkyl glycine.

The amount of surface active agent added varies depending upon whether or not the surface active agent is combined with an alkaline substance, but it is generally preferable to provide a total amount of surface active agent in the divided additions or in the multi-step additions in the range of from 0.05 to 3% by weight, and more preferably in the range of from 0.1 to 1% by weight, based on the amount of coal in the slurry. In this case, when a surface active agent is combined with an alkaline substance, the amount of the agent used can be slightly reduced.

Each divided portion of surface active agents in the divided addition or in the multi-step addition may be identical or different from each other, or may be a mixture of different kinds of surface active agents. When at least two kinds of surface active agents are used, the combination of a cationic one with an anionic one must be avoided, and it is necessary to combine two kinds of surface active agents which do not impair their individual effects of stabilizing the coal slurry and lowering the viscosity of the slurry.

Examples of alkaline substances that can be combined with the above-mentioned surface active agents in the present invention include caustic soda, caustic potash, calcium hydroxide, ammonia, and short carbon chain amines such as methylamine, ethylamine and butylamine and the like. It is preferable that the amount of alkaline substance added is in the range of from 0.02 to 2% by weight, and preferably from 0.04 to 0.5% by weight, based on the amount of coal in the slurry.

As coal used in the present invention, bituminous coal and sub-bituminous coal can be used, but the former having a small value of inherent moisture is preferable. The grinding mill is not limited, and a grinding mill such as a ball mill that is used for normal wet grinding can be used. The amount of coal powder passing through a 200 mesh separator should be at least 50% by weight based on the total amount of coal, as a guideline for the particle size of the ground coal powder, and the particle size distribution of the ground coal is not particularly limited.

The method for adding the surface active agent is not particularly limited. However, in the case of batchwise coal grinding, a divided addition method or multi-step addition method for the surface active agent is adopted in which coal, water, and one divided portion of surface active agent are added to a grinding mill to carry out coal grinding, and while continuing coal grinding, a new divided portion of surface active agent is added into the grinding mill at least once until the grinding is finished. When a continuous wet grinding mill is used for continuous preparation of a coal-water slurry, in several places between the inlet and the outlet of the grinding mill, several injection nozzles are installed to inject dispersing agents through each nozzle into the grinding mill. The dispersing agent may be added without being diluted, or as an aqueous solution thereof.

A coal-water slurry thus made in accordance with the present invention generally has a coal concentration of from 50 to 80% by weight, and preferably from 60 to 75% by weight, and a low viscosity in spite of the very small amount of dispersing agents used in it as compared with the amount of dispersing agent used in a conventional method for preparing a coal slurry; thus, the present invention is extremely useful in practice.

Further, as an additive other than the abovementioned dispersing agents, various additives such as a corrosion inhibitors, chelating agents, etc., may be added, if desired, to a coal-water slurry made in accordance with the present invention.

Next, the present invention is described in more detail by the following examples. The property analysis values of the Miike coal and Blair Athor coal used in the following examples are as follows.

| | | Miike coal | Blair Athor coal |
|---|---|---|---|
| Ash | (% by weight) | 19.6 | 7.2 |
| Volatile matter | (% by weight) | 38.8 | 27.1 |
| Fixed carbon | (% by weight) | 39.9 | 57.1 |
| Inherent moisture | (% by weight) | 2.6 | 4.1 |

EXAMPLE 1

365 g of crushed Miike coal (bituminous coal) having an average particle size of 4 mm or less and a water content of 4% by weight was placed in a ball mill having a capacity of 5 liter (having a ball packing ratio of 30% by volume), and then 116 g of water and 0.35 g of a formaldehyde condensate of sodium naphthalene sulfonate (having a condensation degree of 4) as a dispersing agent (A) were added thereto. The mixture was ground for 20 minutes. After that, the mill was stopped to add further 0.35 g of the same dispersing agent, and then the mixture was further ground for another 10 minutes. Thus, a coal slurry having a particle size of coal powder such that 71% by weight of the powder could pass through a 200 mesh separator, and having a coal concentration of 72.7% by weight was obtained. The viscosity of the slurry determined with a Brookfield viscometer was 1050 cP at 25° C.

For comparison, 365 g of Miike coal and 116 g of water were placed in the same ball mill. In each of the comparative tests, to each comparative mixture the respective amounts of the formaldehyde condensate of sodium naphthalene sulfonate (dispersing agent (A)) as shown in Table 1 were added, all at once at the beginning, and then the coal was ground for 30 minutes. Thus, four comparative slurries were obtained and their properties are shown in Table 1.

TABLE 1

| | Dispersing agent A (g) | Coal-water slurry: Coal con. (% by weight) | Coal-water slurry: Particle size of coal-through 200 mesh (% by weight) | Coal-water slurry: Viscosity (cP) |
|---|---|---|---|---|
| Invention | 0.70 | 72.7 | 71.0 | 1050 |
| Comparison 1 | 0.70 | 72.7 | 70.9 | 2000 |
| Comparison 2 | 0.98 | 72.7 | 71.2 | 1850 |
| Comparison 3 | 1.12 | 72.7 | 70.8 | 1450 |
| Comparison 4 | 1.26 | 72.7 | 71.0 | 1100 |

As shown in Table 1, with the same amount of dispersing agent used, the coal-water slurry made in accordance with the present invention has about half the viscosity of the slurry made by the first comparative method (Comparison 1), and to obtain a viscosity equal to that obtained by the present invention, the comparative method requires 1.8 times the amount of dispersing agent used in the present invention (Comparison 4) .

EXAMPLE 2

The same amounts of Miike coal and water as in EXAMPLE 1 were placed in the same ball mill (having a ball packing ratio of 30% by volume) as in Example 1. To the mixture, 0.5 g of caustic soda as a dispersing agent (B) was added, and then the coal was ground for 10 minutes. After that, the mill was stopped to add 0.7 g of an aqueous 50% by weight solution of the sodium salt of a copolymer (1:1) of styrene with maleic anhydride (having an average molecular weight of 2000) as a dispersing agent (C), and then the mixture was ground further for another 10 minutes. After that, the mill was stopped to add 0.36 g of an aqueous 50% by weight solution of sodium polyacrylate (having an average molecular weight of 5000) as a dispersing agent (D) and then the mixture was ground further for an additinal 10 minutes. Thus, a coal slurry having a particle size of coal powder such that 73% by weight of the powder could pass through a 200 mesh separator and a coal concentration of 72.6% by weight was obtained. The viscosity of the slurry determined with a Brookfield viscometer was 950 cP at 25° C.

For comparison, 365 g of Miike coal and 116 g of water were placed in the same ball mill. In each of the comparative tests, to each comparative mixture the respective amounts of dispersing agents (B), (C) and (D) as shown in Table 2 were added all at once at the beginning, and then the coal was ground for 30 minutes. Thus, three of comparative slurries were obtained and their properties are shown in Table 2.

TABLE 2

| | Dispersing agent | | | Coal-water slurry | | |
|---|---|---|---|---|---|---|
| | B (g) | C (g) | D (g) | Coal conc. (% by weight) | Particle size of coal-through 200 mesh (% by weight) | Viscosity (cP) |
| Invention | 0.5 | 0.7 | 0.36 | 72.6 | 73.0 | 950 |
| Comparison 5 | 0.5 | 0.7 | 0.36 | 72.6 | 73.0 | 2050 |
| Comparison 6 | 0.6 | 0.84 | 0.43 | 72.6 | 73.4 | 1500 |
| Comparison 7 | 0.7 | 0.98 | 0.5 | 72.5 | 73.3 | 960 |

As shown in Table 2, with the same amount of dispersing agents used, the coal-slurry made in accordance with the present invention has less than half the viscosity of the slurry made by the first comparative method (Comparison 5), and to obtain a viscosity equal to that obtained by the present invention, the comparative method requires 1.4 times the amounts of dispersing agents used in the present invention (Comparison 7).

EXAMPLE 3

1340 g of crushed Blair Athor coal having a particle size of 4 mm or less and a moisture content of 6% by weight was placed in a ball mill of a capacity of 20 liters (having a ball packing ratio of 30% by volume). Then, 675 g of water and 2.52 g of an aqueous 50% by weight ammonia solution as a dispersing agent (E) were added into the ball mill, and then the mixture was ground for 10 minutes. After that, the mill was stopped to add 2.5 g of an aqueous 50% by weight solution of the sodium salt of an isobutylene-maleic anhydride copolymer (having an average molecular weight of 3000) as a dispersing agent (F), and then the mixture was ground further for another 10 minutes. After that, 2.5 g of an aqueous 50% by weight solution of the sodium salt of polyoxyethylene (having 60 mols added) octylphenyl ether sulfate as a dispersing agent (G) was added and then the mixture was ground further for an additional 10 minutes. Thus, a coal-water slurry having a particle size of coal powder of 76% by weight of powder passing through 200 mesh and a coal concentration of 62.3% by weight was obtained. The viscosity of the slurry determined with a Brookfield viscometer was 1250 cP at 25° C.

For comparison, 1340 g of Blair Athor coal and 675 g of water were placed in the same ball mill. In each of the comparative tests, to each comparative mixture the respective amounts of dispersing agents (E), (F) and (G) as shwon in Table 3 were added all at once at the beginning and then the coal was ground for 30 minutes. Thus, four kinds of comparative slurries were obtained and their properties are shown in Table 3.

TABLE 3

| | Dispersing agent | | | Coal-water slurry | | |
|---|---|---|---|---|---|---|
| | E (g) | F (g) | G (g) | Coal conc. (% by weight) | Particle size of coal-through 200 mesh (% by weight) | Viscosity (cP) |
| Invention | 2.52 | 2.5 | 2.5 | 62.3 | 76.0 | 1250 |
| Comparison 8 | 2.52 | 2.5 | 2.5 | 62.3 | 75.8 | 3400 |
| Comparison 9 | 3.02 | 3.0 | 3.0 | 62.2 | 75.7 | 2400 |
| Comparison 10 | 3.52 | 3.5 | 3.5 | 62.2 | 76.1 | 1860 |
| Comparison 11 | 4.03 | 4.0 | 4.0 | 62.1 | 76.1 | 1240 |

As shown in Table 3, with the same amounts of dispersing agents used, the coal-water slurry made in accordance with the present invention had about one-third of the viscosity of the slurry made by the first comparative method (Comparison 8), and to obtain a viscosity equal to that obtained by the present invention, the comparative method requires 1.6 times the amounts of dispersing agents used in the present invention (Comparison 11).

While the invention has been described in detail and with reference to specific embodiment thereof, it will be apparent to one skilled in the art that various changes and modifications can be made therein without departing from the spirit and scope thereof.

What is claimed is:

1. A method for preparing a coal-water slurry comprising the divided addition of dispersing agent or multi-step addition of dispersing agent during grinding in a process for preparing a coal-water slurry by the wet grinding of coal in water.

2. A method for preparing a coal-water slurry as in claim 1, wherein the dispersing agent is a cationic surface active agent, an anionic surface active agent, a nonionic surface active agent or an amphoteric surface active agent.

3. A method for preparing a coal-water slurry as in claim 2, wherein the dispersing agent additionally comprises an alkaline substance.

4. A method for preparing a coal-water slurry as in claim 2, wherein the dispersing agent is a surface active agent, and the amount thereof added is from 0.05 to 3% by weight based on the amount of coal in the slurry.

5. A method for preparing a coal-water slurry as in claim 3, wherein an amount of the alkaline substance added is from 0.02 to 2% by weight based on the amount of coal in the slurry.

6. A method for preparing a coal-water slurry as in claim 2, wherein the dispersing agent is an anionic surface active agent selected from the group consisting of a salt of lignin sulfonate, a salt of naphthalene sulfonate, a salt of alkylnaphthalene sulfonate, a salt of alkylbenzene sulfonate, a salt of formaldehyde condensate of said sulfonates, a salt of polyoxyalkylene alkylphenyl ether sulfate, a salt of polyoxyalkylene polyol ether sulfate, a salt of alkyl sulfate, a salt of a fatty acid, a salt of polyacrylic acid, a salt of polymethacrylic acid, and a salt of a copolymer of a polymerizable carboxylic acid with a vinyl compound.

7. A method for preparing a coal-water slurry as in claim 6, wherein said polymerizable carboxylic acid is acrylic acid, methacrylic acid or maleic anhydride and said vinyl compound is α-olefin or styrene.

8. A method for preparing a coal-water slurry as in claim 2, wherein the dispersing agent is a nonionic surface active agent selected from the group consisting of polyoxyalkylene alkyl ether, polyoxyalkylene alkylphenyl ether, polyoxyalkylene alkylamine, polyoxyalkylene fatty acid amide, polyoxyalkylene polyol ether, polyoxyalkylene fatty acid ester, polyoxyalkylene polyol fatty acid ester, and polyol fatty acid ester.

9. A method for preparing a coal-water slurry as in claim 3, wherein the alkaline substance is selected from the group consisting of caustic soda, caustic potash, calcium hydroxide, ammonia, and a short carbon chain amine.

10. A method for preparing a coal-water slurry as in claim 1 wherein said coal-water slurry has a coal concentration of from 50 to 80% by weight.

* * * * *